US012480526B2

(12) United States Patent
Neer et al.

(10) Patent No.: US 12,480,526 B2
(45) Date of Patent: Nov. 25, 2025

(54) PUMP WITH IMPELLER FOR CIRCULATING COOLING FLUID AND RELATED IMPELLER

(71) Applicant: Crane Pumps & Systems PFT Corp., Piqua, OH (US)

(72) Inventors: Kirk Neer, St. Paris, OH (US); Mark Kowalak, Troy, OH (US)

(73) Assignee: Crane Pumps & Systems PFT Corp., Piqua, OH (US)

( * ) Notice: Subject to any disclaimer, the term of this patent is extended or adjusted under 35 U.S.C. 154(b) by 124 days.

(21) Appl. No.: 18/220,616

(22) Filed: Jul. 11, 2023

(65) Prior Publication Data

US 2023/0349393 A1 Nov. 2, 2023

Related U.S. Application Data

(63) Continuation of application No. PCT/US2022/011948, filed on Jan. 11, 2022.

(60) Provisional application No. 63/136,327, filed on Jan. 12, 2021.

(51) Int. Cl.

| | |
|---|---|
| ***F04D 29/58*** | (2006.01) |
| ***F04D 13/06*** | (2006.01) |
| ***F04D 29/10*** | (2006.01) |
| ***F04D 29/22*** | (2006.01) |

(52) U.S. Cl.

CPC ..... *F04D 29/5806* (2013.01); *F04D 13/06* (2013.01); *F04D 29/106* (2013.01); *F04D 29/22* (2013.01)

(58) Field of Classification Search

CPC .... F04D 13/06; F04D 13/0606; F04D 29/106; F04D 29/22; F04D 29/185; F04D 29/4273; F04D 29/5806

USPC ..... 417/423.1, 423.3, 423.7, 423.11, 424.1

See application file for complete search history.

(56) References Cited

U.S. PATENT DOCUMENTS

| | | | | |
|---|---|---|---|---|
| 3,976,391 | A * | 8/1976 | Randell | F04D 29/669 415/58.4 |
| 4,799,855 | A | 1/1989 | Milocco et al. | |
| 5,480,290 | A | 1/1996 | Zelder | |
| 5,616,973 | A | 4/1997 | Khazanov et al. | |
| 6,010,086 | A | 1/2000 | Earle, III et al. | |
| 6,916,152 | B2 | 7/2005 | Keener | |
| 2011/0200469 | A1 * | 8/2011 | Kawabata | F04D 29/5806 417/423.3 |
| 2013/0183178 | A1 | 7/2013 | Bottan | |

(Continued)

*Primary Examiner* — Philip E Stimpert

(74) *Attorney, Agent, or Firm* — Standley Law Group LLP; Jeffrey S. Standley; Jeffrey C. Norris

(57) ABSTRACT

A circulation system is provided to move a coolant liquid in a coolant chamber (44) formed between a housing (40) and a motor shroud (42) of a pump (10) for a fluid being worked upon. The circulation system has a coolant impeller (54) in a coolant impeller chamber (56). The coolant impeller is driven by a drive shaft (20) that also drives a primary impeller (24) that moves the fluid being worked on. The coolant impeller is positioned along the drive shaft between the motor and the primary impeller. The coolant impeller has a wide inner portion (74) and a peripheral base disk (76) that define a radially-offset suction eye (72) and support a plurality of impeller blades (70). A seal spring (86) compressively acts on the inner portion, providing a mechanical seal.

13 Claims, 4 Drawing Sheets

(56) References Cited

U.S. PATENT DOCUMENTS

2017/0167499 A1 6/2017 Calotto et al.

* cited by examiner

PUMP WITH IMPELLER FOR CIRCULATING COOLING FLUID AND RELATED IMPELLER

CROSS-REFERENCE TO RELATED APPLICATIONS

This application is a bypass continuation of PCT Application No. PCT/US2022/011948, Jan. 11, 2022, which claimed priority to U.S. Provisional Application No. 63/136,327, filed Jan. 12, 2021, each of which is incorporated by reference as if fully recited herein.

TECHNICAL FIELD

This disclosure relates to a pump, particularly a pump for use in a basin, having a second impeller, exclusively for circulating a cooling fluid around a motor thereof. The disclosure also relates to the second impeller.

BACKGROUND

In the prior art, many pumps, and especially submersible-rated pumps, are designed for use with a motor positioned above the impeller, with a vertically- or horizontally-oriented drive shaft. In applications where the pump is deployed in a basin, the pump often has a cylindrical shape around the drive shaft which is longer, having a ratio to axial length to diameter being much larger than a pump that is not intended for a basin. When the pump is substantially submerged, the liquid in which it is submerged can provide a sink for the heat generated by the motor. However, when the motor portion is not substantially submerged or the pump is in continuous dry run, the motor can overheat.

When the prior art has attempted to provide an internal cooling system, the impellers that have been used have not provided sufficient coolant flow to the top of the unit during extended dry-run cycles. Some of the prior art solutions have focused on axial impellers that increase flow, but which have been limited in the head provided with only a single-stage unit.

Another known issue in the prior art is the ability to isolate the working impeller from the coolant impeller when both are located along the same drive shaft.

Another approach has been to circulate the working fluid being pumped around the motor as a coolant. In solid handling pumps, especially as in sewage basin applications, the narrow passages provided around the motor become clogged, resulting in overheating.

A few prior art solutions to these problems are presented in U.S. Pat. No. 5,480,290, where the bent tube extends to the top of the jacket to ensure that coolant liquid will be taken from the top zone of the pump, and U.S. Pat. No. 5,616,973, which has a closed loop system with multiple annular circulation passages.

The problems presented remain unsolved in the prior art known to the inventors.

SUMMARY

These and other unmet objects are met by a pump having a coolant circulation system, and especially a coolant circulation system using a coolant impeller having the features understood by the inventors to present an inventive concept. These or other needs may also be satisfied by an impeller.

Such a pump for moving a fluid being worked upon comprises a housing, a drive shaft, a motor, a primary impeller, a secondary impeller and a mechanical seal. The housing will generally be of a cylindrical shape, with the drive shaft positioned along an axial length of the housing. The motor is coupled to a first end of the drive shaft in an upper portion of the housing. A cavity is formed inside the housing and extends from the upper portion to a lower portion. The primary impeller is coupled to a second end of the drive shaft in the lower portion of the housing, and is adapted for receiving the fluid being worked upon through an inlet and expelling it through an outlet of the housing. The secondary impeller is adapted for circulating a coolant in the cavity. The secondary impeller is coupled to the drive shaft above the primary impeller but below the motor. The mechanical seal, positioned along the drive shaft, separates the coolant from the fluid being worked upon.

In many embodiments, the pump also comprises a motor shroud that contains the motor and the drive shaft in a water tight manner. The motor shroud is arranged inside the housing so that a space in the cavity between the motor shroud and the housing defines a coolant chamber.

In some embodiments, the cavity will comprise flow channels for directing circulation of the coolant.

In many embodiments, a coolant impeller chamber is provided for the mounting of the secondary impeller, to be rotated by the drive shaft. In these, and other embodiments, a coolant collection basin is also provided, to be in liquid communication with both the coolant chamber and the coolant impeller chamber, which is preferably located above the coolant collection basin.

An upper shroud of the secondary impeller is provided by a wall of the motor shroud. This upper shroud preferably comprises a conduit that directs coolant, pressurized by the secondary impeller, into the coolant chamber.

The secondary impeller comprises a set of curved impeller blades and a lower shroud. The lower shroud has an inner portion and a peripheral base disk. These are separated by an annular space that defines a suction eye for the secondary impeller. The peripheral base disk and the inner portion anchor each of the set of curved impeller blades.

In the embodiments, the drive shaft enters the coolant impeller chamber through a lower portion of the motor shroud and the mechanical seal; and an O-ring isolates the coolant impeller chamber from an interior of the motor shroud.

It is also preferred to provide a bell-shaped element that spaces the coolant collection basin radially outwardly so that the coolant collection basin is under the suction eye of the secondary impeller.

The mechanical seal contains a seal spring, which, in a compressed condition, acts against the secondary impeller, maintaining a seal.

Exemplary embodiments also include a related impeller, which may or may not be used in such a pump.

In addition to the novel features and advantages mentioned above, other benefits will be readily apparent from the following descriptions of the drawings and exemplary embodiments.

BRIEF DESCRIPTION OF THE DRAWINGS

A better understanding of the inventive concept will be had when reference is made to the accompanying figures, wherein identical parts are identified by identical part numbers and wherein.

DETAILED DESCRIPTION

Figure 1:
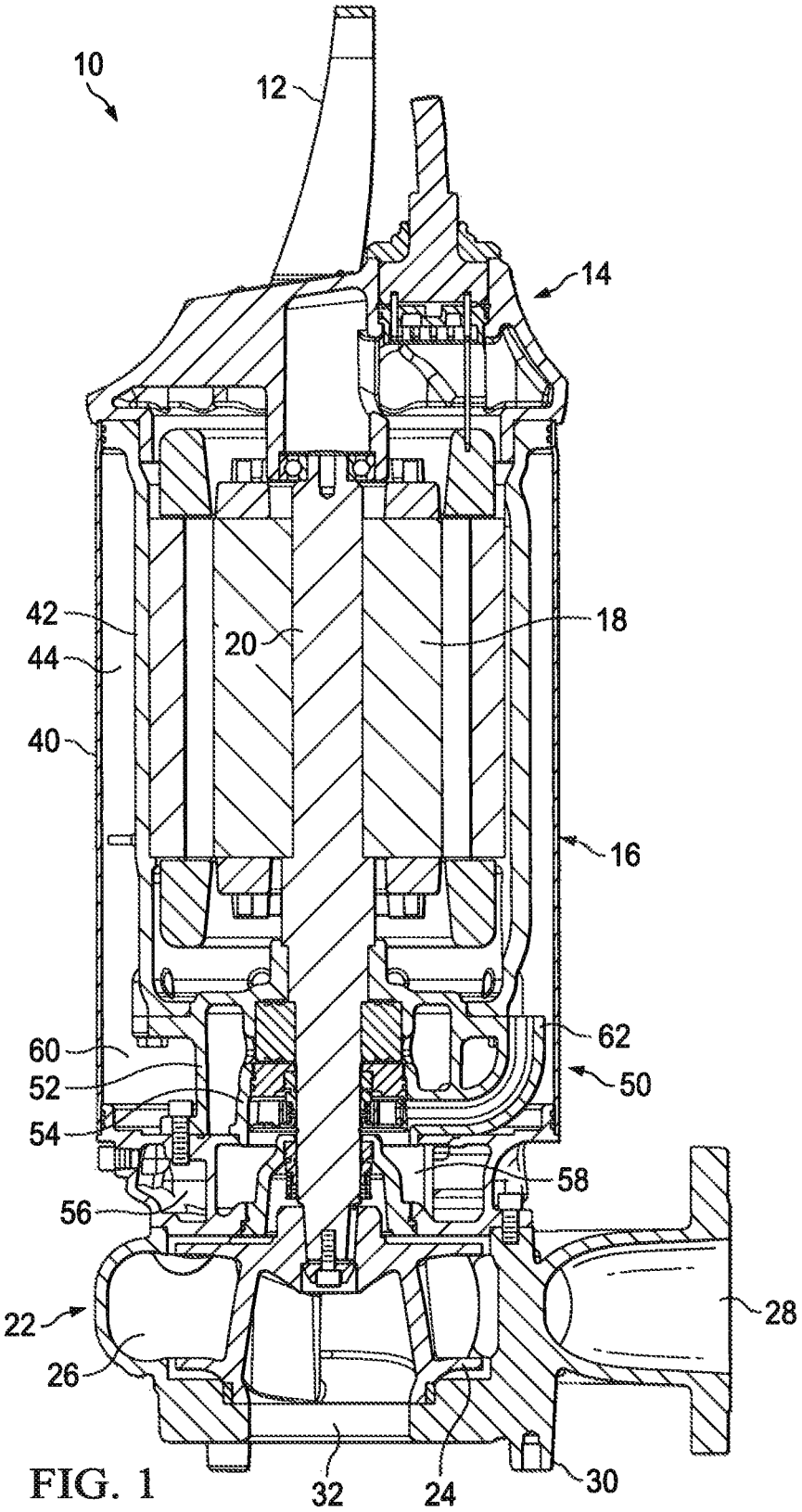
FIG. 1 is a side-section elevation view of a pump incorporating the inventive concept.

FIG. 1 shows a side-sectional elevation of pump 10 that includes the inventive concept. Moving from top to bottom, the pump 10 has a bail 12 that is useful in moving the pump into or out of a basin (not shown), a top portion 14 that receives power and control information from an upper portion of the basin, an intermediate portion 16 that contains a motor 18, a drive shaft 20 coupled to the motor, and a cooling system for the motor. Below the intermediate portion 16 is a bottom portion 22 that contains a primary impeller 24, coupled to the drive shaft 20 and surrounded by a chamber 26 in which fluid from a lower portion of the basin is received and pressurized for discharge through an outlet 28, which is adapted for connection to piping that leads out of the basin. Many of the features of the pump 10 described so far are generally known in the art, but the inventive concept lies in the cooling system.

The bottom portion 22 of pump 10 typically rests upon a floor of the basin, although a plurality of legs 30 may be used to space an axial inlet 32 of the chamber 26 above the basin floor. While not shown in this embodiment, it is known to position a grinder element in or proximate to the axial inlet 32, to reduce the size of solids, particularly stringy solids, that could clog the primary impeller 24. The specific configuration of the primary impeller 24 and the chamber 26 in which it is positioned will largely be design choices that will not affect the inventive concept being disclosed herein, but the preferred primary impeller 24 will be a centrifugal impeller.

Directing attention more closely to the intermediate portion 16 of pump 10, a housing 40 will preferably be a cylindrical metal tube, adapted at its respective ends for water-tight attachment to the top portion 14 and the bottom portion 22. The motor 18 and drive shaft 20 are contained in a water-tight manner within a motor shroud 42 that is mounted at a top end thereof to the top portion 14 and the housing 40. Motor shroud 42 is generally cylindrical, with a diameter that is smaller than a diameter of the housing 40. This difference in diameters provides for a coolant chamber 44, which may be generally open, but which also may contain defined flow channels for circulation of a coolant liquid. In the preferred manner of operation, the coolant chamber 44 will be substantially filled with the coolant liquid, although a small headspace is desirable at the upper end of the coolant chamber 44 to accommodate expansion/contraction of the coolant liquid during use, as gas in the headspace is able to be compressed. Surfaces of the housing 40 and motor shroud 42 that face into the coolant chamber 44 may be provided with fins or other elements to enhance heat transfer. Further, the outer surface of the housing 40 may similarly be provided with shaped surfaces to enhance heat transfer from the pump 10 into the interior of the basin, keeping in mind that this outer surface may be exposed to air, the liquid in the basin, or a combination of both.

Continuing with FIG. 1, the coolant system for the pump 10 comprises a coolant circulation system 50, in addition to the coolant chamber 44 and the coolant liquid contained therein. In the illustrated embodiment, this coolant circulation system 50 has a coolant circulation system housing 52 positioned in the intermediate portion 16, directly below the motor shroud 42, to which it is mounted at an upper end thereof. The features of the coolant circulation system 50 include a coolant impeller 54, a coolant impeller chamber 56, and a coolant collection basin 58. The coolant circulation system housing 52 is also mounted to the bottom portion 22. The drive shaft 20 passes from the motor shroud 42 into and through the coolant circulation system housing 52, ending with an end of the drive shaft that extends into the bottom portion 22, where it is coupled to the primary impeller 24. In this manner, the coolant liquid is kept in circulation.

Also notable as features of the coolant circulation system are at least one passage 60 that communicates the coolant chamber 44 to the coolant collection basin 58, and a conduit 62 at a discharge of the coolant impeller chamber 56 that communicates it to the coolant chamber 44.

However, the most notable feature of the coolant circulation system is the coolant impeller 54 which solves problems that the inventors do not believe have been successfully addressed in the prior art. The coolant impeller 54 needs to circulate the coolant to cool the motor 18 while operating in a wide range of conditions ranging from fully submerged to continuous dry run. The coolant impeller 54 is designed to obtain enclosed impeller flow characteristics and higher efficiencies and the reliability and ease of use of an open impeller. The coolant impeller 54 uses a wall of the motor shroud 42 located above it as its upper shroud 66. A lower shroud of the coolant impeller 54 is a combination of shroud, suction eye, and a seal spring to provide a mechanical seal. Instead of the traditional suction eye being in the center (as it is in the primary impeller 24), the coolant impeller 54 has a suction eye that is offset into an open annular shape, which allows the inner portion to be acted on by the seal spring of the mechanical seal. A further section of the coolant impeller 54 provides the remaining portion of the shroud for the coolant impeller.

A known problem in the prior art with impellers for circulating coolant in this sort of application is getting the cooling liquid to the top of the motor shroud unit with enough flow to cool during extended dry-run cycles. Axial impellers can provide more flow but are limited in the amount of head that can be generated with only single stage units.

Figure 2:
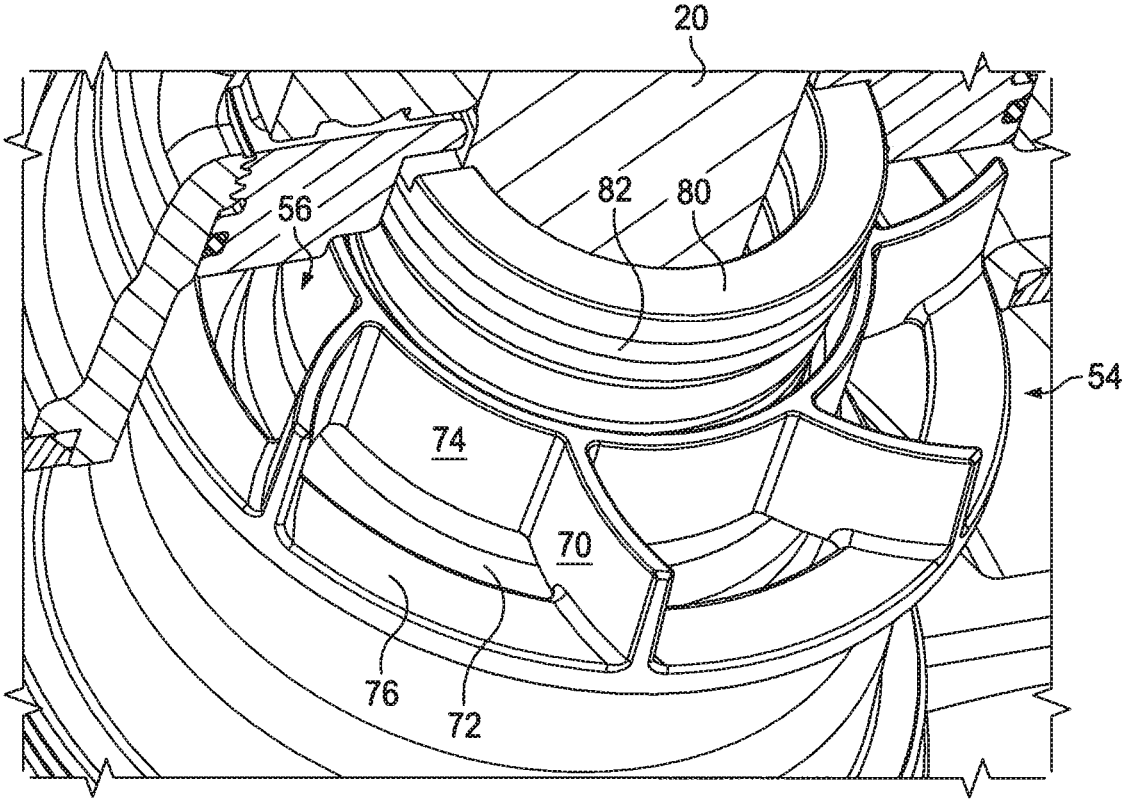
FIG. 2 is a top partial section perspective view of a coolant circulation system of the FIG. 1 pump.
Figure 3:
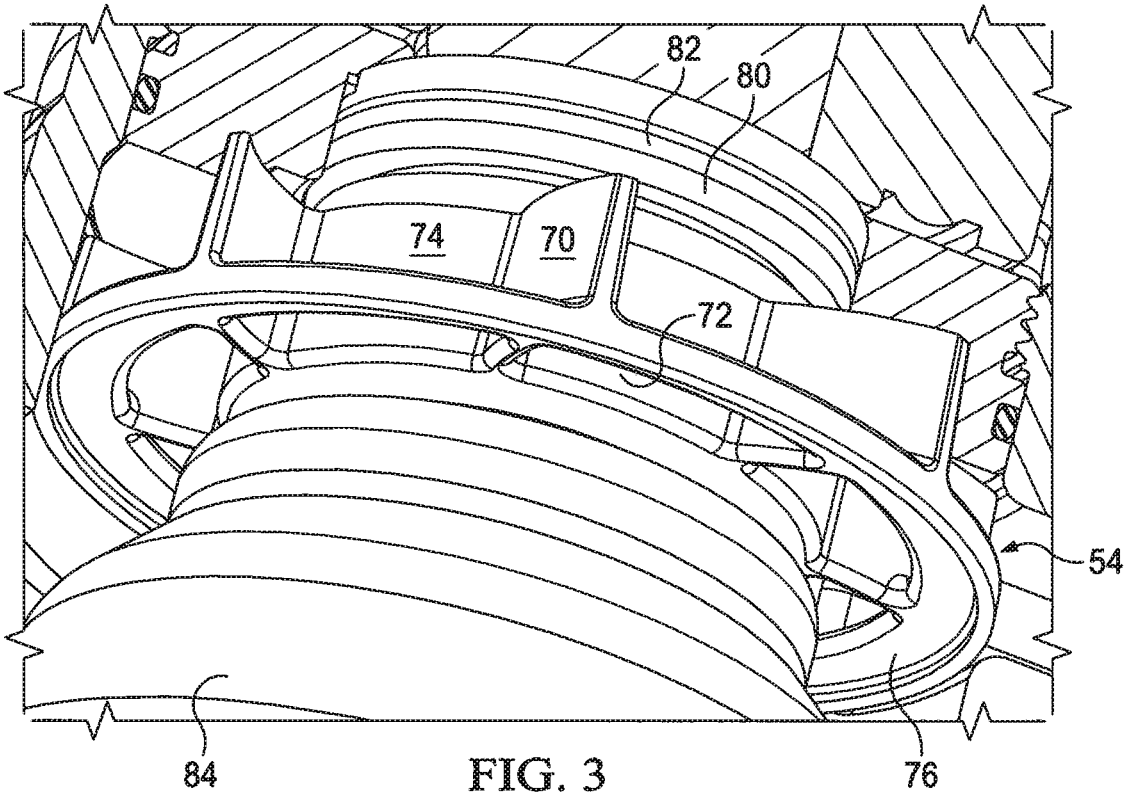
FIG. 3 is a rear partial section perspective view of the coolant circulation system.
Figure 4:
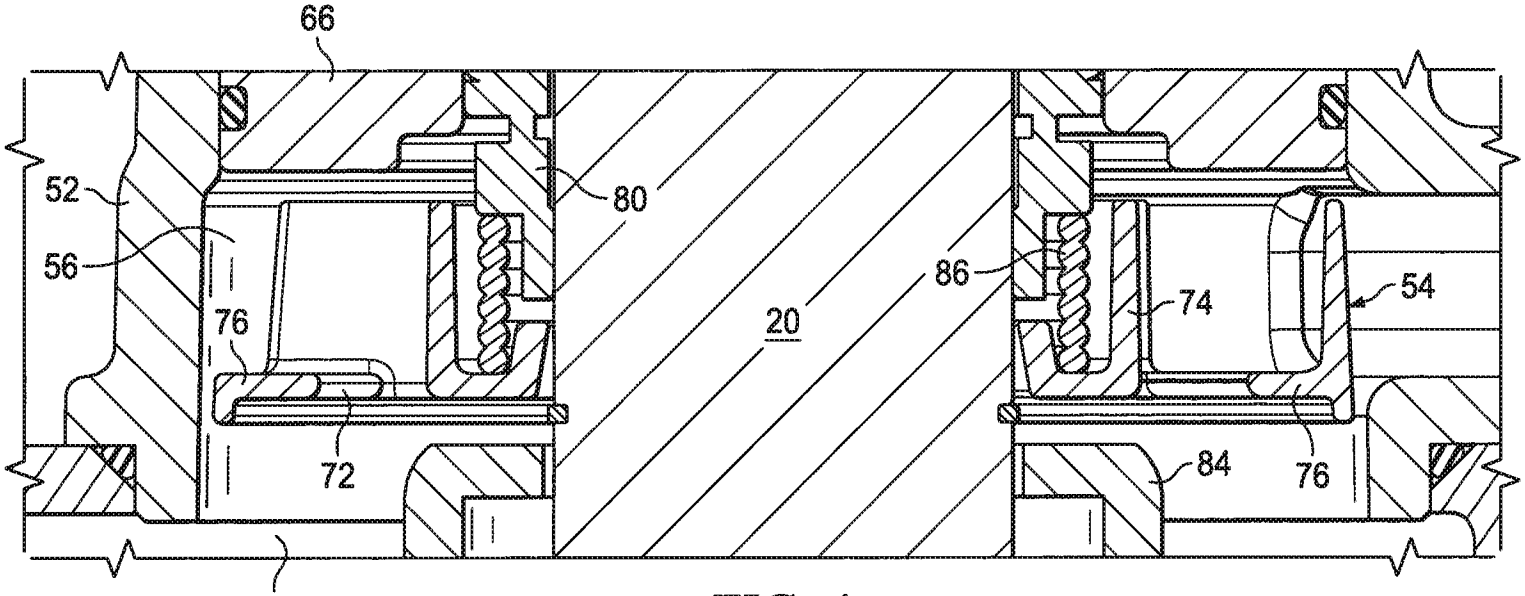
FIG. 4 is a side section elevation view of the coolant circulation system.
Figure 5:
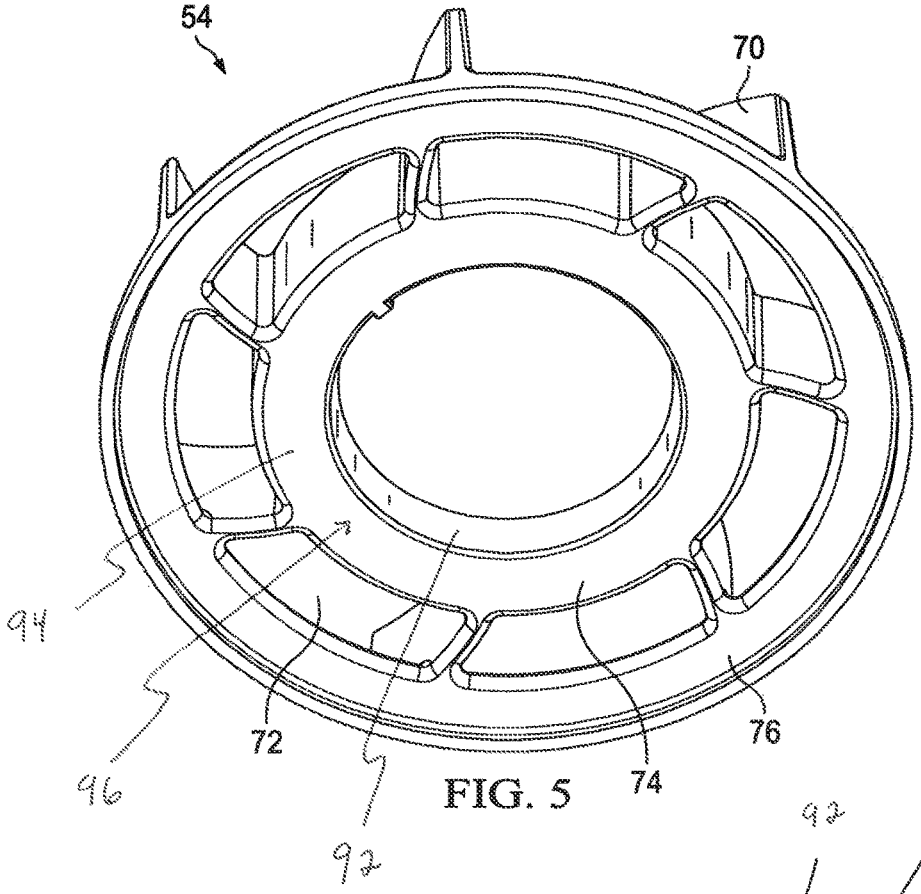
FIG. 5 is a bottom perspective view of the coolant impeller, isolated from the pump.
Figure 6:
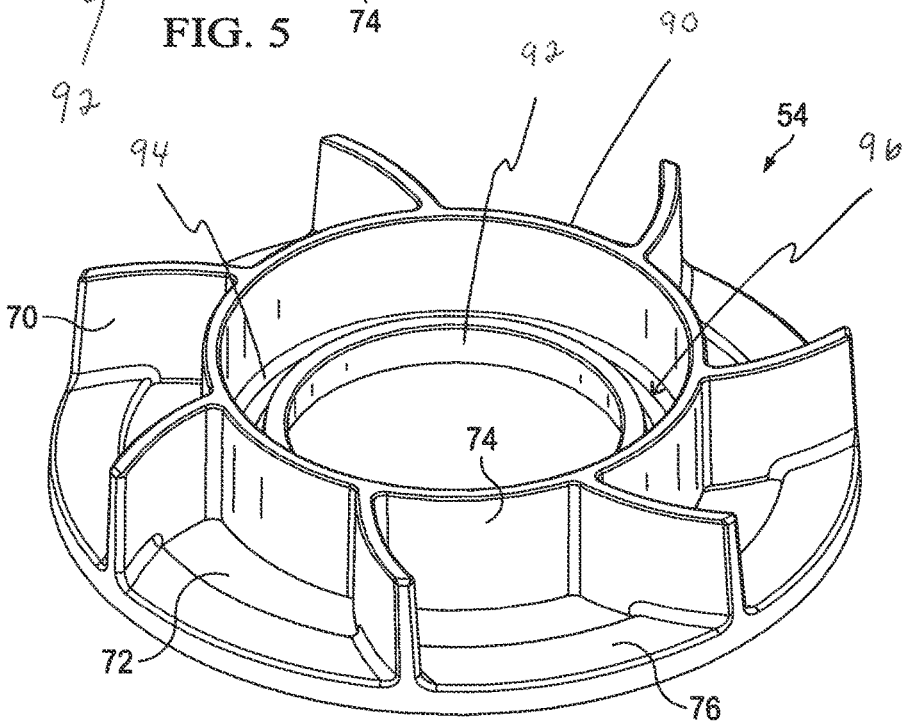
FIG. 6 is a top perspective view of the coolant impeller, isolated from the pump.

FIGS. 2 through 6 depict various views of the coolant impeller 54 that embody the inventive concept. FIGS. 2 to 4 show the coolant impeller 54 in its operative relationship with the pump and particularly with the coolant circulation system. FIGS. 5 and 6 show the coolant impeller 54 in isolation so that the individual features may be understood.

The inventive concept as understood by the inventor has four main features. The first of these is a set of curved impeller blades 70 to provide the push to the coolant to enable it to reach the vertical reaches of the coolant chamber 44. Specifics of the blades 70, including the vane geometry and number of impeller blades 70 may be varied depending on the amount of flow and head required to cool the pump 10 assembly in which it is installed.

The second main feature is the suction eye 72 of the coolant impeller 54. Instead of being located in the center of the coolant impeller 54, as would be known in the prior art, the suction eye 72 is offset radially outward. The offset position allows an inner portion 74 to interact with a mechanical seal spring and to pass the drive shaft 20 through the coolant impeller chamber 56. The suction eye 72 depicted in the drawings is a generally open annular space between the inner portion 74 and a peripheral base disk 76. This base disk 76, along with the inner portion 74, anchors the plurality of blades 70, and it is only the axial projection of these blades that keeps the suction eye from being fully open. The suction eye 72 allows coolant liquid to flow through the vanes from the coolant collection chamber 58 below the coolant impeller chamber 56 through the blades 70, where the coolant liquid is propelled through the rest of the assembly.

The third feature is positioned below the suction eye 72, where the lower shroud is arranged to define the size of the suction eye, provide direction of flow and improve the efficiency of the impeller.

The fourth feature is the upper shroud 66. Since the upper shroud 66 is provided by a wall of the motor shroud 42, which is directly above it, the upper shroud helps to provide direction of flow and improves the efficiency of the coolant impeller 54. A feature of the upper shroud 66 is the conduit 62 that directs the pressurized coolant liquid from the upper side of the impeller into the coolant chamber 44.

Directing attention to FIGS. 2 and 3, where top and bottom perspective views look into the coolant impeller chamber 56, which is shown in section to view its internals. Drive shaft 20 enters through the lower part of the motor shroud 42 and a mechanical seal 80, and an O-ring 82 isolates the coolant impeller chamber 56 from the interior of the motor shroud 42. Coolant circulation system housing 52 provides a wall to the coolant impeller chamber 56 and coolant liquid can flow outside of it through conduit 62 into coolant chamber 44.

Below the impeller 54, a bell-shaped element 84 spaces the coolant collection chamber 58 radially outwardly so that it is primarily under the suction eye of the impeller. The bell-shaped element 84 also isolates the drive shaft 20 from the coolant liquid, positions the impeller 54 along the drive shaft and assists in fixing the coolant circulation system housing system 52 to the bottom portion (not shown in FIG. 2 or 3).

Looking now at FIG. 4, a side section view of the impeller 54 and its surroundings shows the blades 70, suction eye 72, inner portion 74 and base disk 76. A portion of upper shroud 66 is seen, as is a portion of bell-shaped element 84. A seal spring 86 of the mechanical seal 80, in a compressed condition is able to act on the inner portion 74 of the impeller 54.

FIGS. 5 and 6 show perspective views of the coolant impeller 54, isolated from the pump. Readily visible are the blades 70, inner portion 74, base disk 76 and the suction eye 72 provided as an opening between the inner portion and the base disk.

In an exemplary embodiment, an inner portion 74 may also be referred to as a central hub. Referring again to FIGS. 5 and 6, this example of central hub 74 comprises an outer wall member 90, an inner wall member 92, and an annular disk 94, that joins a lower surface (such as shown in FIG. 5) of each of the outer wall member 90 and the inner wall member 92 in a spaced-apart relationship, closing a lower surface of the central hub 74. As previously described, the coolant impeller 54 further comprises a plurality of curved impeller blades 70, wherein a first end of each impeller blade 70 is formed integrally with, and extends from, the outer wall 90 of the central hub 74. Additionally, as in previous embodiments, the coolant impeller 54 comprises a peripheral annular disk 76, which is joined to a second end of at least some of the impeller blades 70, such that the peripheral annular disk 76 and the central hub annular disk 94 define or form at least a portion of a lower shroud 96 of the centrifugal impeller 54 with an annular space 72 between the respective annular disks defining a suction eye 72. In an exemplary installation, such as but not limited to the exemplary use in a pump as shown in FIGS. 1-4, the central hub 74 is configured to couple the centrifugal impeller 54 to the drive shaft 20 along an intermediate portion of the drive shaft 20, along a height of the outer wall member 90 and in a pocket 96 formed by the outer wall member 90, the inner wall member 92, and the annular disk 94 of the central hub 74. For example, such as shown in FIGS. 1-4, a mechanical seal 80 may be configured to be positioned in the pocket 96 to facilitate coupling impeller 54 to drive shaft 20, and thereby separate the coolant from the fluid being worked upon.

Other exemplary embodiments of a pump may comprise a second impeller having a different configuration. In addition, a second impeller as described may have an alternative purpose or may be useful for a pump having a different configuration.

Any embodiment of the present invention may include any of the optional or preferred features of the other embodiments of the present invention. The exemplary embodiments herein disclosed are not intended to be exhaustive or to unnecessarily limit the scope of the invention. The exemplary embodiments were chosen and described in order to explain some of the principles of the present invention so that others skilled in the art may practice the invention. Having shown and described exemplary embodiments of the present invention, those skilled in the art will realize that many variations and modifications may be made to the described invention. Many of those variations and modifications will provide the same result and fall within the spirit of the claimed invention. It is the intention, therefore, to limit the invention only as indicated by the scope of the claims.

What is claimed is:

1. A pump for moving a fluid being worked upon, comprising:

a housing;

a drive shaft, positioned along an axial length of the housing;

a motor, coupled to a first end of the drive shaft in an upper portion of the housing;

a cavity, formed inside the housing and extending from the upper portion to a lower portion of the housing;

a motor shroud that contains the motor and the drive shaft in a water tight manner, the motor shroud arranged inside the housing so that a space in the cavity between the motor shroud and the housing defines a coolant chamber;

a primary impeller, coupled to a second end of the drive shaft in the lower portion of the housing, the primary impeller adapted for receiving the fluid being worked upon through an inlet and expelling it through an outlet of the housing;

a secondary impeller, adapted to rotate and circulate a coolant in the coolant chamber, the secondary impeller coupled to the drive shaft between the primary impeller and the motor;

a coolant impeller chamber, in which the secondary impeller is mounted for rotation by the drive shaft;

a coolant collection basin, in liquid communication with both the coolant chamber and the coolant impeller chamber, which is located above the coolant collection basin; and a mechanical seal, along the drive shaft, that is adapted to separate the coolant from the fluid being worked upon;

wherein rotation of the secondary impeller is adapted to draw coolant upward from the coolant collection basin and subsequently push the coolant upward into the coolant chamber.

2. The pump of claim 1, wherein the cavity comprises flow channels for directing circulation of the coolant.

3. The pump of claim 1, wherein:

an upper shroud of the secondary impeller is provided by a wall of the motor shroud.

4. The pump of claim 3, wherein:

the upper shroud comprises a conduit adapted to direct coolant, pressurized by the secondary impeller, into the coolant chamber.

5. The pump of claim 3, wherein the secondary impeller comprises:

a set of curved impeller blades; and a lower shroud, having an inner portion and a peripheral base disk, the inner portion and peripheral base disk separated by an annular space that defines a suction eye for the secondary impeller;

wherein the peripheral base disk and the inner portion anchor each of the set of curved impeller blades.

6. The pump of claim 5, further comprising:

a bell-shaped element that spaces the coolant collection basin radially outwardly so that the coolant collection basin is under the suction eye of the secondary impeller.

7. The pump of claim 1, wherein the secondary impeller comprises:

a set of curved impeller blades; and a lower shroud, having an inner portion and a peripheral base disk, the inner portion and peripheral base disk separated by an annular space that defines a suction eye for the secondary impeller;

wherein the peripheral base disk and the inner portion anchor each of the set of curved impeller blades.

8. The pump of claim 7, further comprising:

a bell-shaped element that spaces the coolant collection basin radially outwardly so that the coolant collection basin is under the suction eye of the secondary impeller.

9. The pump of claim 1, wherein:

the drive shaft enters the coolant impeller chamber through a lower portion of the motor shroud and the mechanical seal; and an O-ring isolates the coolant impeller chamber from an interior of the motor shroud.

10. The pump of claim 1, further comprising:

a seal spring of the mechanical seal, which, in a compressed condition, acts against the secondary impeller, maintaining a seal.

11. The pump of claim 1 wherein the coolant collection basin is adjacent to the lower portion of the housing and adapted to facilitate heat transfer to fluid in the lower portion being worked on.

12. The pump of claim 1, wherein the secondary impeller comprises:

a central hub, having an outer wall member, an inner wall member and an annular disk that joins a lower surface of each of the outer wall member and the inner wall member in a spaced-apart relationship, closing a lower surface of the central hub;

a plurality of curved impeller blades, a first end of each impeller blade formed integrally with, and extending from, the outer wall of the central hub; and a peripheral annular disk, joined to a second end of at least some of the impeller blades, such that the peripheral annular disk and the central hub annular disk define a lower shroud of the centrifugal impeller with an annular space between the respective annular disks defining a suction eye.

13. The pump of claim 12, wherein:

the central hub is configured to couple the secondary impeller to a drive shaft along an intermediate portion of the drive shaft, along a height of the outer wall member and in a pocket formed by the outer wall member, the inner wall member, and the annular disk of the central hub.

* * * * *